US011625000B2

(12) United States Patent
Sakuwa

(10) Patent No.: US 11,625,000 B2
(45) Date of Patent: Apr. 11, 2023

(54) PROCESS UNIT AND IMAGE FORMING APPARATUS

(71) Applicant: SHARP KABUSHIKI KAISHA, Sakai (JP)

(72) Inventor: Tohru Sakuwa, Sakai (JP)

(73) Assignee: SHARP KABUSHIKI KAISHA, Sakai (JP)

( * ) Notice: Subject to any disclaimer, the term of this patent is extended or adjusted under 35 U.S.C. 154(b) by 0 days.

(21) Appl. No.: 17/536,884

(22) Filed: Nov. 29, 2021

(65) Prior Publication Data

US 2022/0171327 A1 Jun. 2, 2022

(30) Foreign Application Priority Data

Dec. 2, 2020 (JP) ..... JP2020-200367

(51) Int. Cl.
*G03G 21/16* (2006.01)
*G03G 21/18* (2006.01)
*G03G 15/02* (2006.01)

(52) U.S. Cl.
CPC ..... *G03G 21/1814* (2013.01); *G03G 15/0225* (2013.01)

(58) Field of Classification Search
CPC ..... G03G 15/0216; G03G 15/0225; G03G 15/0233; G03G 21/1814
See application file for complete search history.

(56) References Cited

U.S. PATENT DOCUMENTS

2009/0297206 A1* 12/2009 Fujishiro ..... G03G 21/0058 15/256.52

FOREIGN PATENT DOCUMENTS

JP 2006-330607 * 12/2006 ..... G03G 15/02
JP 2007-121544 A 5/2007

* cited by examiner

*Primary Examiner* — Hoang X Ngo
(74) *Attorney, Agent, or Firm* — ScienBiziP, P.C.

(57) ABSTRACT

A process unit includes: a photosensitive drum on a surface of which a toner image is formed; a charging roller being pressed against the photosensitive drum so as to charge the photosensitive drum; a cleaning roller being pressed against the charging roller so as to clean the charging roller; and at least one biasing member biasing the charging roller or the cleaning roller. A central axis of the photosensitive drum is located at a position not overlapping with a central axis line passing through a central axis of the charging roller and a central axis of the cleaning roller. A biasing direction of the at least one biasing member is on a same line as the central axis line.

4 Claims, 11 Drawing Sheets

PROCESS UNIT AND IMAGE FORMING APPARATUS

CROSS-REFERENCE TO RELATED APPLICATION

This application claims priority under 35 U.S.C. § 119 (a) on Patent Application No. 2020-200367 filed in Japan on Dec. 2, 2020, the entire contents of which are herein incorporated by reference.

TECHNICAL FIELD

The present invention relates to a process unit that transfers a toner image and an image forming apparatus.

BACKGROUND ART

In conventional image forming apparatuses using an electrographic image forming method, a toner image is formed by charging a surface of a photosensitive drum to adhere toner. An image is formed by transferring this toner image to a paper sheet. Recently, various methods have been proposed for charging the photosensitive drum. For example, a contact charging method is adopted, in which a charging roller having conductivity comes directly into contact with a photosensitive drum.

An image forming apparatus disclosed in JP 2007-121544 A includes: a charging roll charging an object to be charged; a cleaning member cleaning the charging roll; a holding member supporting the charging roll and the cleaning member so as to keep a relative positions of the charging roll and the cleaning member substantially constant; a housing to which the holding member is slidably attached; and a biasing unit biasing the holding member toward the object to be charged such that the charging roll is pressed against the object to be charged.

In the above image forming apparatus, the load applied to the end parts of the charging roll held by the holding member is different from the load applied to the middle part of the charging roll away from the holding member. For this reason, the shaft of the charging roll may be distorted. Furthermore, the above image forming apparatus has a configuration in which the biasing unit biases the holding member in the direction in which the object to be charged and the charging roll face each other. Therefore, since the distance between the charging roll and the object to be charged changes due to distortion of the shaft, the nip width between the object to be charged and the charging roll is also uneven, which may cause electric potential change to the photosensitive body.

The present invention was made in consideration of the above circumstances, an object of which is to provide a process unit capable of uniformly charging a photosensitive drum without reducing transmission efficiency of pressure contact force to a charging roller, and also to provide an image forming apparatus including the above process unit.

SUMMARY OF THE INVENTION

A process unit of the present invention is a process unit transferring a toner image. The process unit includes: a photosensitive drum on a surface of which a toner image is formed; a charging roller being pressed against the photosensitive drum so as to charge the photosensitive drum; a cleaning roller being pressed against the charging roller so as to clean the charging roller; and at least one biasing member biasing the charging roller or the cleaning roller. A central axis of the photosensitive drum is located at a position not overlapping with a central axis line passing through a central axis of the charging roller and a central axis of the cleaning roller. A biasing direction of the at least one biasing member is on the same line as the central axis line.

The process unit of the present invention may further include bearing parts rotatably supporting the central axis of the charging roller and the central axis of the cleaning roller. A distance between the central axis of the charging roller and the central axis of the cleaning roller may be fixed by the bearing parts.

In the process unit of the present invention, the at least one biasing member may include a charging roller biasing member that biases the charging roller and a cleaning roller biasing member that biases the cleaning roller.

In the process unit of the present invention, the charging roller biasing member may be provided along the central axis line, and the cleaning roller biasing member may be provided along a line passing through the central axis of the photosensitive drum and the central axis of the cleaning roller.

In the process unit of the present invention, the cleaning roller biasing member may be provided along the central axis line, and the charging roller biasing member may be provided along a line passing through the central axis of the photosensitive drum and the central axis of the charging roller.

In the process unit of the present invention, the charging roller and the cleaning roller may be disposed under the photosensitive drum in the height direction.

In the process unit of the present invention, the charging roller may have a crown shape.

An image forming apparatus of the present invention includes the process unit of the present invention.

With the present invention, the charging roller is not biased straightly toward the central axis of the photosensitive drum. Thus, it is possible to reduce displacement of the contact position to the photosensitive drum caused by distortion of the shaft of the charging roller. Thus, it is possible to uniformly charge the photosensitive drum without reducing transmission efficiency of pressure contact force to the charging roller.

DESCRIPTION OF THE PREFERRED EMBODIMENTS

First Embodiment

Hereinafter, an image forming apparatus according to the first embodiment of the present invention will be described with reference to the drawings.

Figure 1:
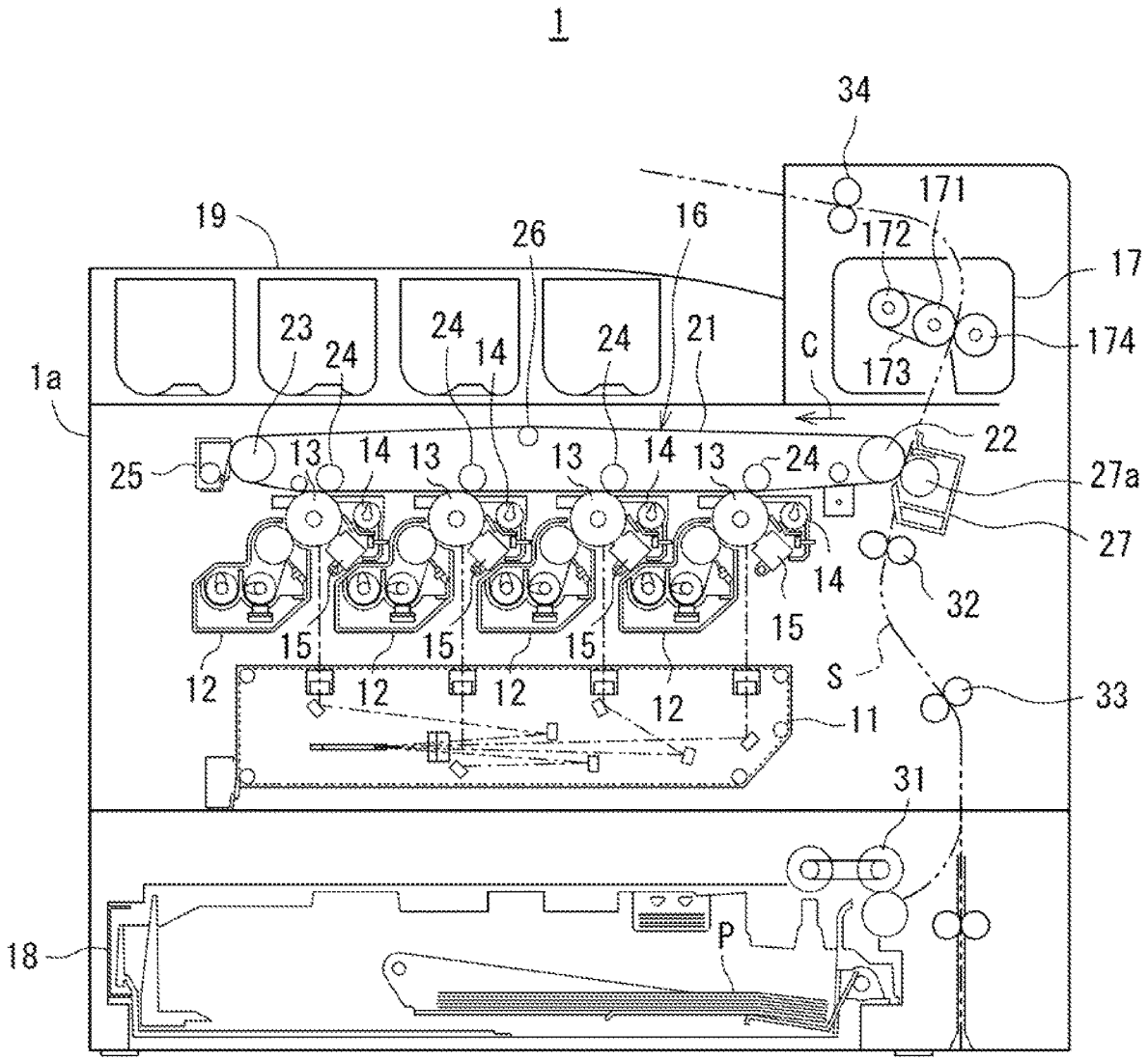
FIG. 1 is a schematic configuration diagram illustrating an image forming apparatus according to a first embodiment of the present invention.

FIG. 1 is a schematic configuration diagram illustrating an image forming apparatus according to the first embodiment of the present invention.

An image forming apparatus 1 is to form a multicolor or monochrome image on a predetermined paper sheet according to image data received from an external device. The image forming apparatus 1 includes: a light exposure unit 11; a developing unit 12; a photosensitive drum 13; a cleaning unit 14; a charger 15; an intermediate transfer belt unit 16; a fixing device 17; a sheet feed cassette 18; and a discharge tray 19.

Image data handled by the image forming apparatus 1 corresponds to a color image using respective colors of black (K), cyan (C), magenta (M), and yellow (Y). In order to form four kinds of latent images corresponding to the respective colors, the image forming apparatus 1 includes the following components: four developing devices 12, four photosensitive drums 13, four chargers 15 and four drum cleaning units 14. Each of the respective kinds of four components corresponds to black, cyan, magenta, and yellow. Thus, four image stations are constituted.

The photosensitive drums 13 are located at a substantially center part of the image forming apparatus 1. The charger 15 uniformly charges a surface of the photosensitive drum 13 at a predetermined electric potential. The light exposure unit 11 exposes the surface of the photosensitive drum 13 to form an electrostatic latent image on the surface thereof. The developing unit 12 develops the electrostatic latent image on the surface of the photosensitive drum 13 so as to form a toner image on the surface of the photosensitive drum 13. By the above series of operations, the toner images in respective colors are formed on the surfaces of the respective photosensitive drums 13. The cleaning unit 14 removes and collects residual toner on the surface of the photosensitive drum 13 after developing and transferring the image. As to the configuration in the vicinity of the photosensitive drum 13 and the charger 15, a detail description will be given later referring to FIG. 2.

The intermediate transfer belt unit 16 is provided above the photosensitive drums 13. The intermediate transfer belt unit 16 includes: an intermediate transfer belt 21; an intermediate transfer belt drive roller 22; an intermediate transfer belt driven roller 23; an intermediate transfer roller 24; an intermediate transfer belt cleaning unit 25; and a tension roller 26. Here, four intermediate transfer rollers 24 are provided corresponding to the image stations in the respective colors (Y, M, C and K).

The intermediate transfer belt 21 is wrapped, in a tensioned state, around: the intermediate transfer belt drive roller 22; the intermediate transfer belt driven roller 23; the intermediate transfer rollers 24; and the tension roller 26, so that the surface of the intermediate transfer belt 21 is moved in a predetermined direction (in the direction indicated by the arrow C in FIG. 1).

During circular movement of the intermediate transfer belt 21 in the direction indicated by the arrow C, the residual toner is removed and collected by the intermediate transfer belt cleaning unit 25, while the toner images in the respective colors formed on the surfaces of the photosensitive drums 13 are sequentially transferred and superimposed on one after another so as to form a multicolor toner image on the surface of the intermediate transfer belt 21.

A nip region is formed between a transfer roller 27*a* of a secondary transfer unit 27 and the intermediate transfer belt 21. A paper sheet P, which has been transported via a sheet transport path S, is further transported with being sandwiched in the nip region. When the paper sheet P passes through the nip region, the toner image on the surface of the intermediate transfer belt 21 is transferred on the paper sheet P.

The sheet feed cassette 18 is a cassette in which paper sheets P used for image forming are stored in a stacking manner. The sheet feed caste 18 is provided under the light exposure unit 11. The discharge tray 19 is provided above an image forming device 1*a*. The discharge tray 19 is a tray on which the image-formed paper sheet P is placed.

In the image forming apparatus 1, the paper sheet P in the sheet feed cassette 18 is transported on the sheet transport path S so as to be sent to the discharge tray 19 via the secondary transfer unit 27 and the fixing device 17. Along the sheet transport path S are provided feed rollers 31, registration rollers 32, pre-registration rollers 33, the fixing device 17 and discharge rollers 34.

The feed rollers 31 are provided in the vicinity of the end part of the sheet feed cassette 18 so as to supply the paper sheet P, one by one, from the sheet feed cassette 18 to the sheet transport path S. The registration rollers 32 temporarily hold the paper sheet P transported from the sheet feed cassette 18 and start to transport the paper sheet P to the transfer roller 27*a* at a timing when the leading edge of the toner image superimposed on the photosensitive drums 13 is aligned with the leading edge of the paper sheet P. The pre-registration rollers 33 are small rollers that allow the paper sheet P to be smoothly transported.

The fixing device 17 is a device using a belt fixing method. A fixing belt 173 is wrapped around a plurality of rollers (here, a fixing roller 171 and a heating roller 172). The fixing belt 173 transfers heat from the heating roller 172 to the fixing roller 171. In the fixing device 17, a pressure roller 174 is pressed against the fixing roller 171 via the fixing belt 173. The fixing device 17 receives the paper sheet P on which an unfixed toner image is formed, and transports it by sandwiching between the fixing belt 173 and the pressure roller 174. The paper sheet P after the toner image is fixed is discharged onto the discharge tray 19 by the discharge rollers 34.

In this embodiment, the fixing device 17 is a device using a belt fixing method. However, the fixing device 17 is not limited thereto. It may be a fixing device in which the pressure roller 174 is directly pressed against the fixing roller 171.

In the image forming apparatus 1, the photosensitive drum 13 and the charger 15 are included in a process unit 40 as components. Here, the process unit 40 according to the first embodiment of the present invention is described with reference to the drawings.

Figure 2:
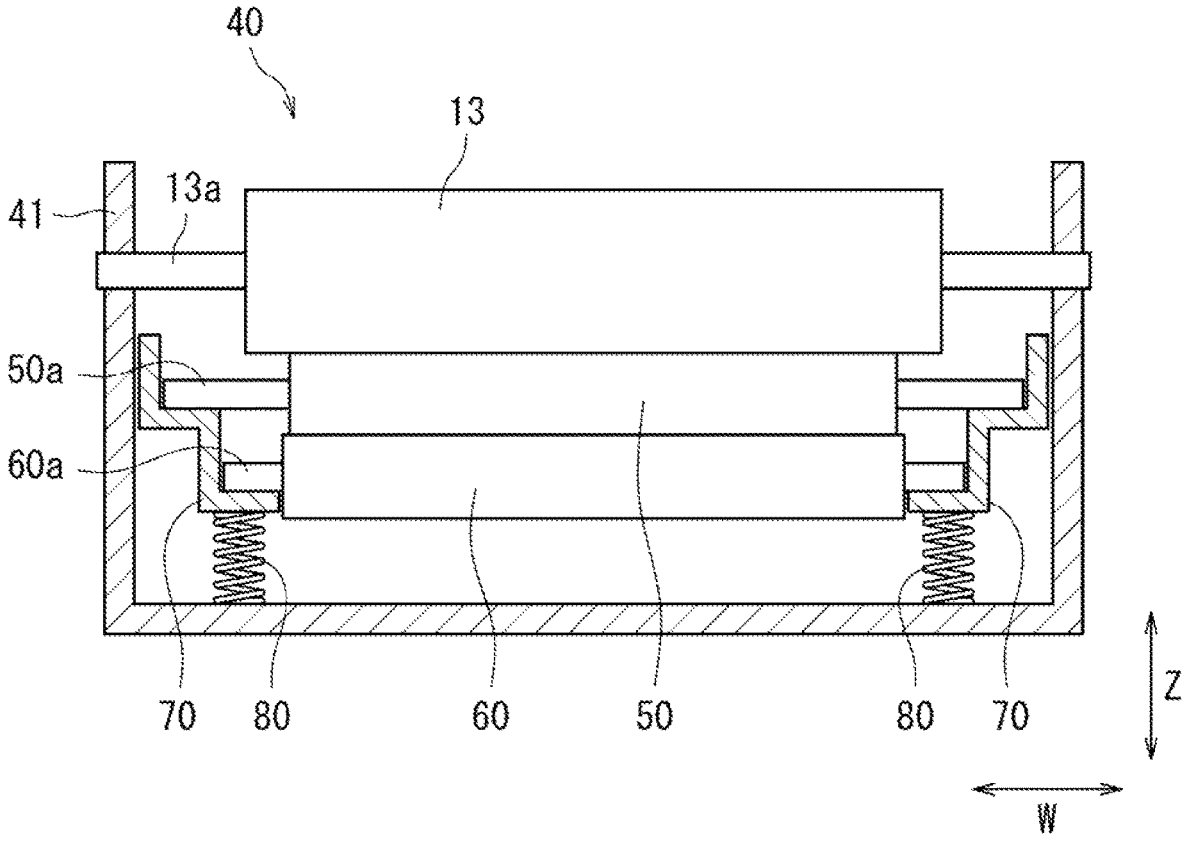
FIG. 2 is a schematic front view illustrating a process unit according to the first embodiment of the present invention.
Figure 3:
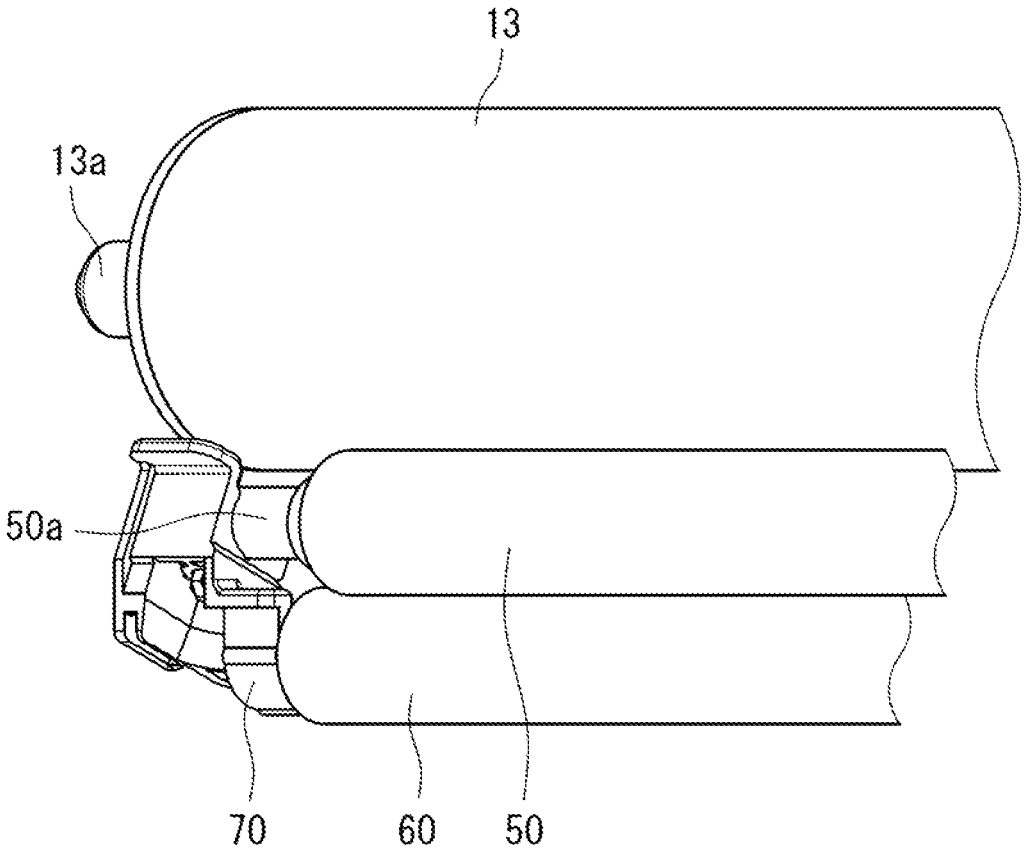
FIG. 3 is an enlarged perspective view extracting and indicating an end part of the process unit.

FIG. 2 is a schematic front view illustrating the process unit according to the first embodiment of the present invention. FIG. 3 is an enlarged perspective view extracting and indicating an end part of the process unit. For the sake of understandability of the structure, a housing 41 and bearing parts 70 are indicated by the hatched lines in FIG. 2. Also for the sake of visibility of the diagram in FIG. 3, some components of the process unit 40 are extracted and indicated. Specifically, the photosensitive drum 13, a charging roller 50, a cleaning roller 60 and the bearing part 70 at one end part are extracted.

The process unit 40 according to the first embodiment of the present invention includes: the photosensitive drum 13; the charging roller 50; and the cleaning roller 60. In the image forming apparatus 1 shown in FIG. 1, a toner image is transferred to a paper sheet from the photosensitive drums 13 via the intermediate transfer belt 21. However, the present invention is not limited thereto. A toner image may be directly transferred to a paper sheet from the photosensitive drum 13. In this case, a nip region is formed by the transfer roller 27*a* being pressed against the photosensitive drum 13. Accordingly, the process unit 40 may also include the transfer roller 27*a*.

Both end parts of a central axis (a photosensitive drum shaft 13*a*) of the photosensitive drum 13 in a width direction W are pivotably supported by a housing 41.

The charging roller 50 is located under the photosensitive drum 13 in a height direction Z, and both end parts of a central axis (a charging roller shaft 50*a*) in the width direction W are pivotably supported by the bearing parts 70. In this embodiment, the charging roller 50 is made of epichlorohydrin rubber and has a diameter of Φ12. The charging roller shaft 50*a* has a diameter of Φ6. Also, the charging roller 50 may have a crown shape having unevenness such that the diameter of the middle part thereof in the width direction W is larger than the diameter of both end parts.

The cleaning roller 60 is located under the charging roller 50 in the height direction Z, and both end parts of a central axis (a cleaning roller shaft 60*a*) in the width direction W are pivotably supported by the bearing parts 70. In this embodiment, the charging roller 60 is made of urethane foam and has a diameter of Φ11.3. The cleaning roller shaft 60*a* has a diameter of Φ6.

The bearing parts 70 are respectively provided at both end parts in the width direction W so as to rotatably support the charging roller shaft 50*a* and the cleaning roller shaft 60*a* in a state in which the distance between the charging roller shaft 50*a* and the cleaning roller shaft 60*a* is fixed. Between the bearing parts 70 and the housing 41, two biasing members 80 are provided corresponding to the two bearing parts 70. The two biasing members 80 bias the respective bearing parts 70 upward. In this embodiment, the biasing member 80 is a coil spring having a spring load of 600 gf. In this way, since both the charging roller 50 and the cleaning roller 60 are pivotably supported by the bearing parts 70, the cleaning roller 60 can be stably pressed against the charging roller 50, which results in maintenance of stable cleaning performance.

The bearing parts 70 and the housing 41 may be provided with recesses and protrusions so as to regulate the moving direction of the bearing parts 70 to the biasing direction by the biasing members 80.

In this embodiment, the photosensitive drum shaft 13*a* of the photosensitive drum 13 is connected to a drive part (not shown) so as be rotated by transmitted driving force. The charging roller 50 is pressed against the photosensitive drum 13, and thus is rotated accompanied by the drive of the photosensitive drum 13 to charge the photosensitive drum 13. The cleaning roller 60 is pressed against the charging roller 50, and thus is rotated accompanied by the rotation of the charging roller 50 to clean dirt on the charging roller 50.

Now, a description is given on the relationship between the biasing direction by the biasing member 80 and the positions of the photosensitive drum 13, the charging roller 50 and the cleaning roller 60, with reference to FIG. 4 to FIG. 6B.

Figure 4:
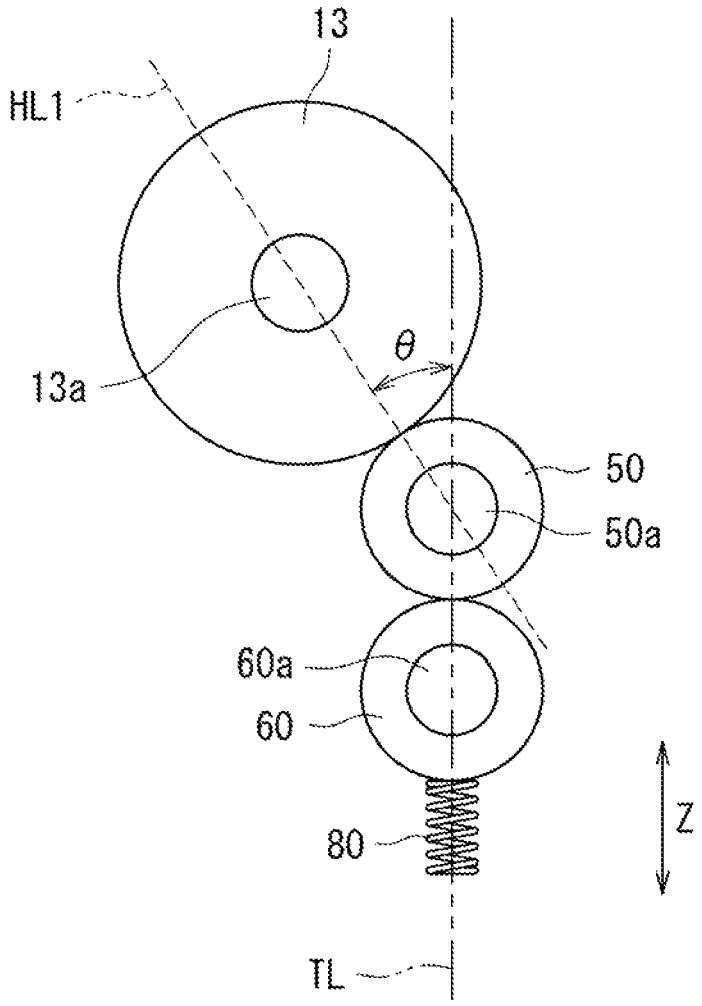
FIG. 4 is a schematic side view indicating a relationship between a biasing direction and respective positions of a photosensitive drum, a charging roller and a cleaning roller.

FIG. 4 is a schematic side view indicating a relationship between the biasing direction and respective positions of the photosensitive drum, the charging roller and the cleaning roller.

FIG. 4 schematically indicates the positional relationship among the photosensitive drum 13, the charging roller 50, the cleaning roller 60 and the biasing member 80 viewed from one end part. The housing 41, the bearing part 70 and the like are omitted. In FIG. 4, although the biasing member 80 is separated from the charging roller shaft 50*a* and the cleaning roller shaft 60*a*, the biasing force of the biasing member 80 is transmitted to the charging roller shaft 50*a* and the cleaning roller shaft 60*a* via the bearing part 70.

As shown in FIG. 4, the charging roller shaft 50*a* is not located directly below the photosensitive drum shaft 13*a*, but is located at a position displaced along the outer circumferential surface of the photosensitive drum 13 (at the lower right in FIG. 4). The cleaning roller shaft 60*a* is located directly below the charging roller shaft 50*a*. In FIG. 4, the dashed line is a first auxiliary line HL1 passing through the photosensitive drum shaft 13*a* and the charging roller shaft 50*a*, and the dashed double-dotted line is a central axis line TL passing through the charging roller shaft 50*a* and the cleaning roller shaft 60*a*. That is, the photosensitive drum shaft 13*a* is located at a position not overlapping with the central axis line TL, and the cleaning roller shaft 60*a* is located at a position not overlapping with the first auxiliary line HL1. The biasing member 80 is disposed along the central axis line TL in a state in which the central axis line TL passes through the center of the biasing member 80. Thus, the biasing direction of the biasing member 80 is on the same line as the central axis line TL. In this embodiment, the central axis line TL and the first auxiliary line HL1 intersect with each other, and the angle between the central axis line TL and the first auxiliary line HL1 (inclination angle θ) is about 10 to 15°.

In the configuration in which the charging roller 50 charges the photosensitive drum 13, when the shaft of the charging roller 50 is distorted, the nip width varies depending on whether it is the width of the end parts or the width of the middle part, which results in electric potential change. In this embodiment, the biasing direction of the biasing member 80 is inclined with respect to the first auxiliary line HL1, accordingly, the nip width is not likely to be affected.

Here, a description is given on the relationship between the biasing direction and the respective positions of the photosensitive drum 13 and the charging roller 50 referring to FIGS. 5A to 5B and 6A to 6B respectively indicating the conventional configuration as a comparative example and the embodiment of the present invention. Since FIGS. 5A to 6B focus on the photosensitive drum 13 and the charging roller 50, the other components such as the cleaning roller 60 and the biasing member 80 are omitted. Also in FIGS. 5B and 6B, the bent of the charging roller 50 is emphasized than the actual state for the purpose of clarifying changes in the shape of the charging roller 50.

Figure 5A:
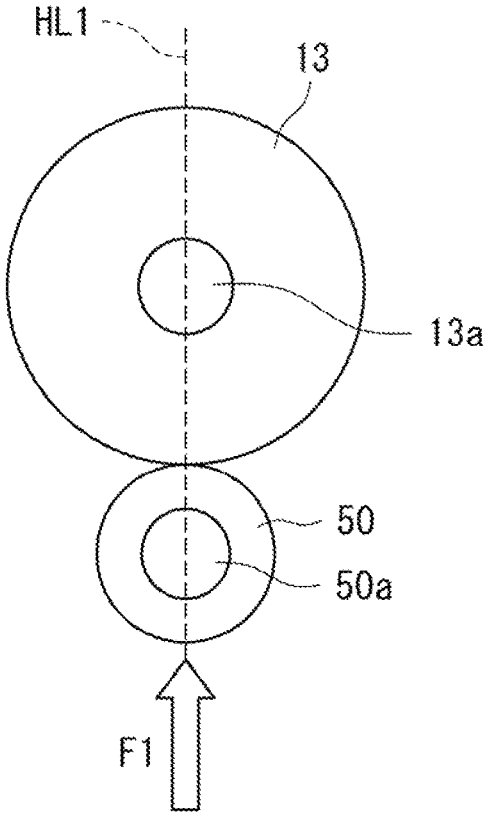
FIG. 5A is a schematic side view indicating a biasing direction and respective positions of a photosensitive drum and a charging roller in a comparative example.
Figure 5B:
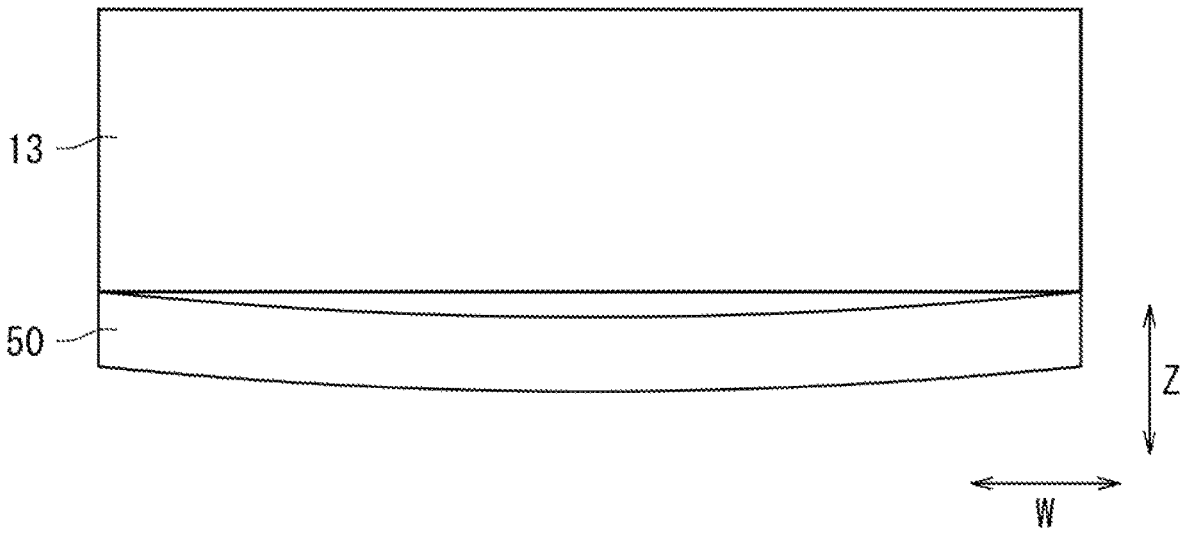
FIG. 5B is a schematic front view indicating the photosensitive drum and the charging roller in FIG. 5A.

FIG. 5A is a schematic side view indicating the biasing direction and the respective positions of the photosensitive drum and the charging roller in a comparative example. FIG. 5B is a schematic front view indicating the photosensitive drum and the charging roller in FIG. 5A.

In the comparative example shown in FIGS. 5A and 5B, the charging roller shaft 50*a* is located directly below the photosensitive drum shaft 13*a*, and thus the charging roller shaft 50*a* is biased directly upward. That is, the biasing force from the biasing member 80 (i.e. a first biasing force F1) functions in the same direction as the first auxiliary line HL1.

Since the charging roller 50 is pivotably supported at both end parts in the width direction W, the load applied to each of the end parts is different from the load applied to the middle part. Accordingly, as shown in FIG. 5B, the charging roller 50 is bent in the biasing direction. That is, both end parts of the charging roller 50 come into contact with the photosensitive drum 13 while the middle part of the charging roller 50 has a gap between the photosensitive drum 13 caused by the bent. Consequently, although both end parts in the width direction W have the nip width set in advance, the middle part has the nip width narrower than the nip width at the both end parts, which generates differences in charged potential. The differences in charged potential affect the adhered amount of toner, which leads to change in image quality or degradation of cleaning quality.

Figure 6A:
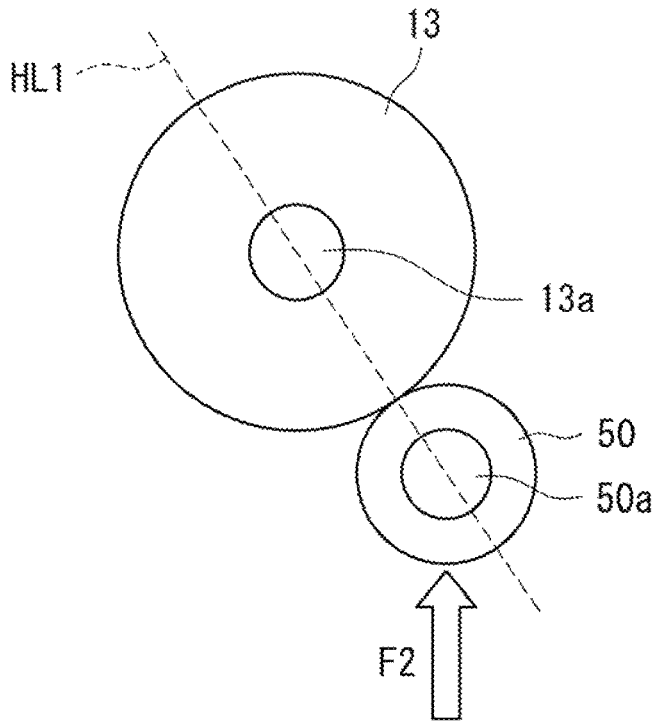
FIG. 6A is a schematic side view indicating the biasing direction and respective positions of the photosensitive drum and the charging roller in the first embodiment of the present invention.
Figure 6B:
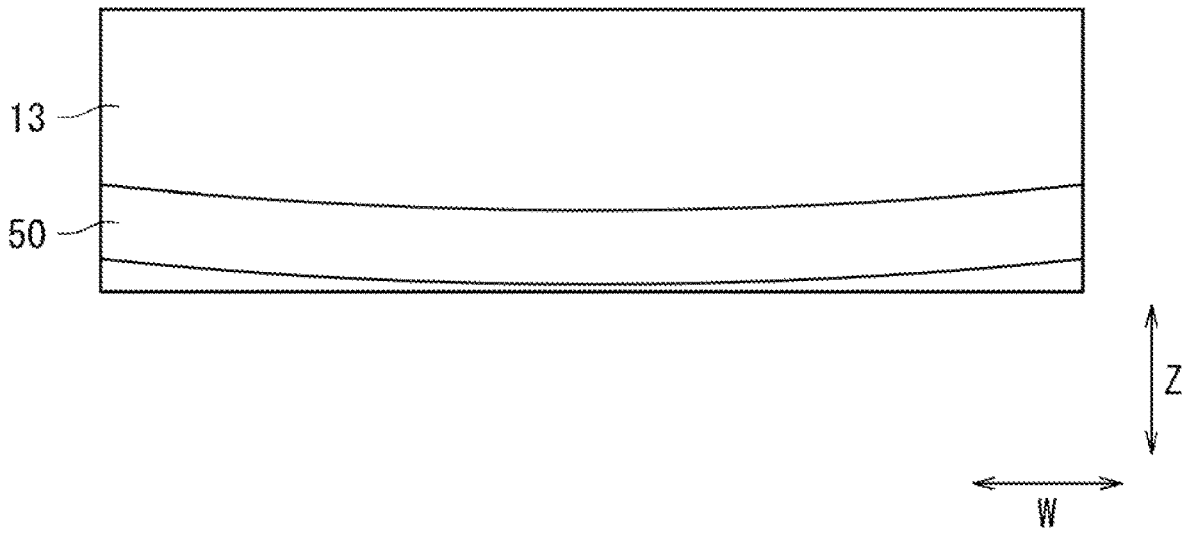
FIG. 6B is a schematic front view indicating the photosensitive drum and the charging roller in FIG. 6A.

FIG. 6A is a schematic side view indicating the biasing direction and the respective positions of the photosensitive drum and the charging roller in the first embodiment of the present invention. FIG. 6B is a schematic front view indicating the photosensitive drum and the charging roller in FIG. 6A.

In the first embodiment of the present invention as described above, the charging roller shaft 50*a* is located at a position slightly displaced from the position directly below the photosensitive drum shaft 13*a*, and the charging roller shaft 50*a* is biased directly upward. That is, biasing force from the biasing member 80 (i.e. a second biasing force F2) functions in the direction intersecting with the first auxiliary line HL1.

In this embodiment also, the charging roller 50 is bent as shown in FIG. 6B. However, since the direction in which the charging roller shaft 50*a* and the photosensitive drum shaft 13*a* face each other (i.e. the direction of the first auxiliary line HL1) is displaced from the direction in which the warp is generated (i.e. the direction of the second biasing force F2), the gap generated by the warp is reduced.

In this embodiment as described above, the charging roller 50 is not biased straightly toward the central axis of the photosensitive drum 13. Thus, it is possible to reduce displacement of the contact position to the photosensitive drum 13 caused by distortion of the shaft of the charging roller 50. Thus, it is possible to uniformly charge the photosensitive drum 13 without reducing transmission efficiency of the pressure contact force to the charging roller 50.

In FIG. 4, the biasing member 80 applies biasing force in the direction of the height direction Z. However, the present invention is not limited thereto. It is sufficient that the respective positions of the photosensitive drum shaft 13*a*, the charging roller shaft 50*a* and the cleaning roller shaft 60*a* are arranged such that the central axis line TL and the first auxiliary line HL1 intersect with each other. That is, the charging roller shaft 50*a* may be located at a position directly below the photosensitive drum shaft 13*a*, and in this case, the biasing member 80 is arranged to apply biasing force in the direction inclined with respect to the height direction Z.

It is preferable that the charging roller 50 and the cleaning roller 60 are disposed under the photosensitive drum 13 in the height direction Z. With this configuration, even when the shaft bends downward by its own weight, the constant nip width can be maintained because the charging roller 50 and the cleaning roller 60 are biased upward, which is a direction displaced from the central axis of the photosensitive drum 13.

Also, by adopting the charging roller 50 having a crown shape, it is possible to reduce the distortion of the shaft and to maintain the constant nip width. However, the present invention is not limited thereto. The charging roller 50 may have a straight cylinder shape having a constant diameter.

Figure 7:
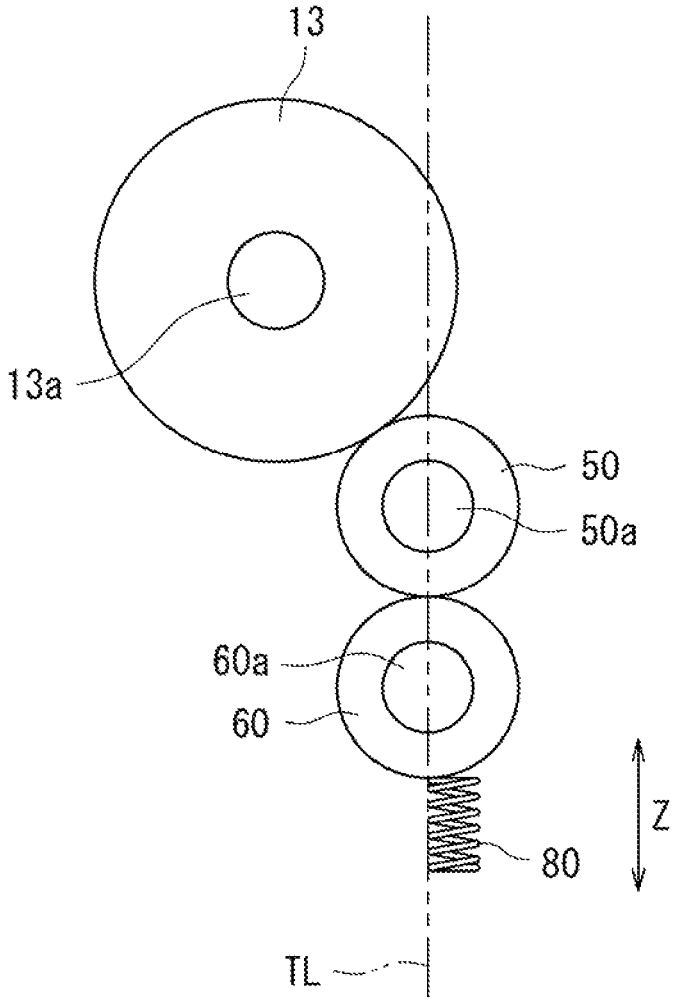
FIG. 7 is a schematic side view indicating a position of the biasing member in a variation.

As shown in a variation shown in FIG. 7, the biasing member 80 may be disposed such that the central axis line TL passes through a side end of the biasing member 80. It is sufficient that the center of the cleaning roller shaft 60*a* is on the central axis line TL while the biasing force of the biasing member 80 is applied to the cleaning roller 60. In other words, when the central axis line TL passes through the biasing member 80 so as to be parallel with the biasing direction, it can be considered that the biasing direction of the biasing member 80 is on the same line as the central axis line TL. The load from biasing member 80 may be adjusted by the bearing part 70 so as to be applied to the charging roller shaft 50*a* and the cleaning roller shaft 60*a*.

Second Embodiment

Hereinafter, an image forming apparatus (process unit) according to the second embodiment of the present invention will be described with reference to the drawings. Since the configuration of the image forming apparatus according to the second embodiment is substantially the same as that in the first embodiment, the common configuration is indicated by the same reference numerals, and the description and the drawing thereof are omitted.

Figure 8:
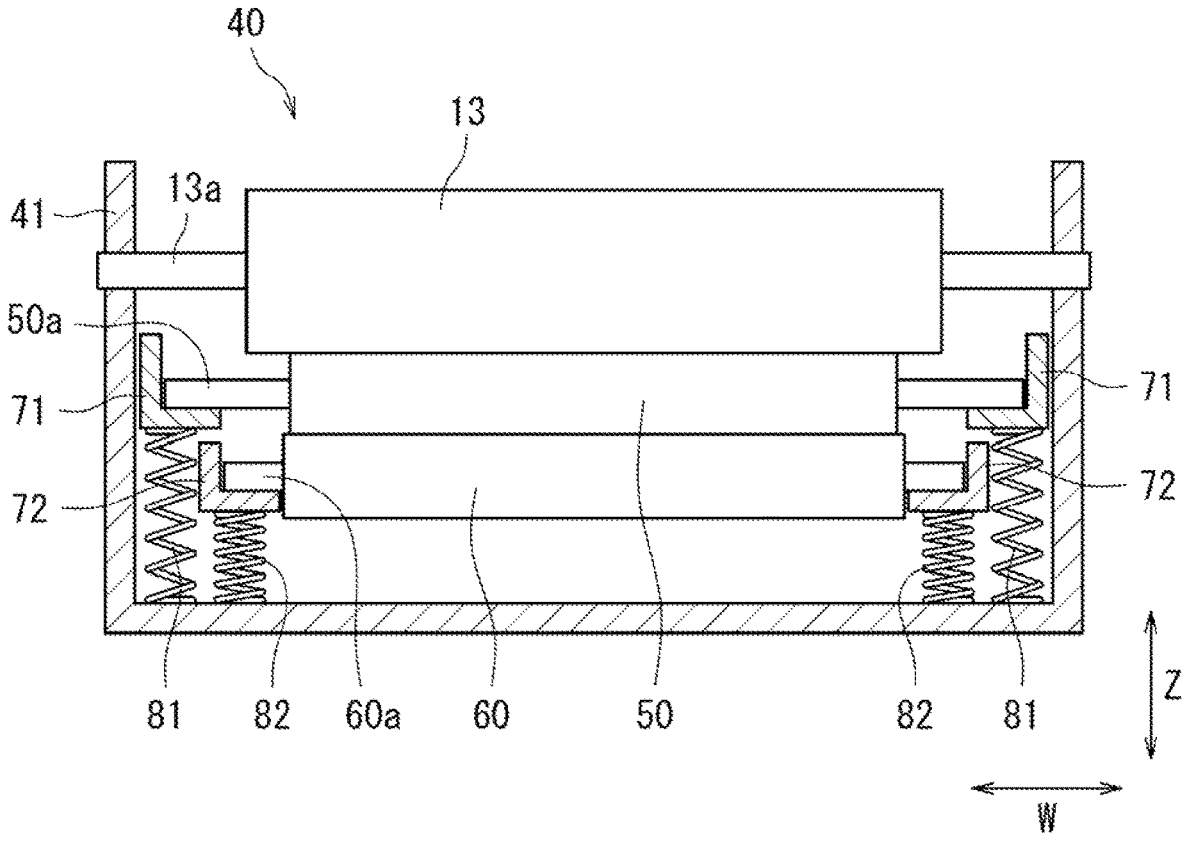
FIG. 8 is a schematic front view illustrating a process unit according to a second embodiment of the present invention.

FIG. 8 is a schematic front view illustrating the process unit according to the second embodiment of the present invention. For the sake of understandability of the structure, the housing 41, a charging roller shaft bearing part 71 and a cleaning roller shaft bearing part 72 are indicated by the hatched lines in FIG. 8.

The second embodiment of the present invention differs from the first embodiment in the configuration in which the charging roller shaft 50*a* and the cleaning roller shaft 60*a* are pivotably supported independently. More specifically, in the second embodiment, the charging roller shaft bearing part 71 and the cleaning roller shaft bearing part 72 are provided in place of the bearing part 70. Both end parts of the charging roller shaft 50*a* are pivotably supported by the charging roller shaft bearing parts 71. Both end parts of the cleaning roller shaft 60*a* are pivotably supported by the cleaning roller shaft bearing parts 72.

Also, as to the biasing members in this embodiment, charging roller biasing members 81 are provided to bias the charging roller 50, and cleaning roller biasing members 82 are provided to bias the cleaning roller 60. Specifically, the charging roller biasing member 81 is disposed between the charging roller shaft bearing part 71 and the housing 41, and the cleaning roller biasing member 82 is disposed between the cleaning roller shaft bearing part 72 and the housing 41. In this way, since the charging roller 50 and the cleaning roller 60 are independently biased, it is possible freely design biasing force and/or biasing direction depending on the arrangement of the respective components.

In this embodiment, the biasing direction of the charging roller biasing member 81 may be different from the biasing direction of the cleaning roller biasing member 82. Thus, three arrangement examples respectively having the different biasing directions (i.e. the first arrangement example to the third arrangement example) are described here referring to FIGS. 9 to 11. In the second embodiment, the arrangement of the photosensitive drum 13, the charging roller 50 and the cleaning roller 60 is the same as that in the first embodiment. Therefore, the description of this arrangement is omitted here, along with their relationships with the central axis line TL and with the first auxiliary line HL1.

Figure 9:
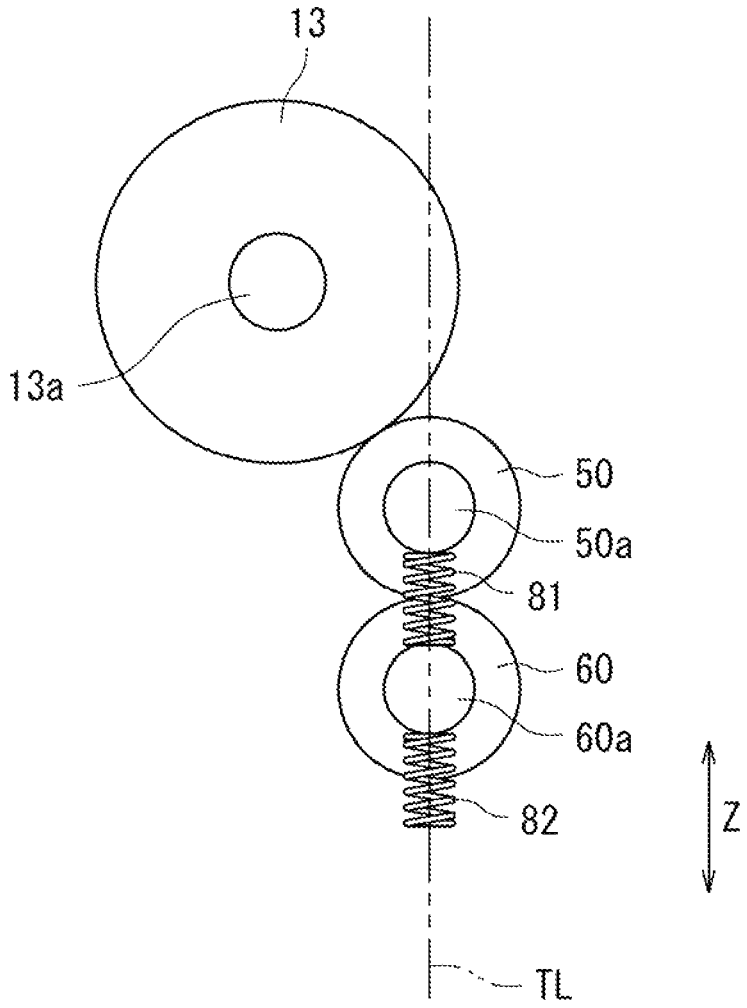
FIG. 9 is a schematic side view indicating a biasing direction in a first arrangement example.

FIG. 9 is a schematic side view indicating the biasing direction in the first arrangement example.

In the first arrangement example, both the charging roller biasing member 81 and the cleaning roller biasing member 82 are provided along the central axis line TL. Thus, the biasing direction of each of the charging roller biasing member 81 and the cleaning roller biasing member 82 is on the same line as the central axis line TL. Although the charging roller biasing member 81 and the cleaning roller biasing member 82 have the same biasing direction, the charging roller 50 and the cleaning roller 60 are independently biased. Thus, it is possible to design respective loads applied to the charging roller 50 and the cleaning roller 60.

Figure 10:
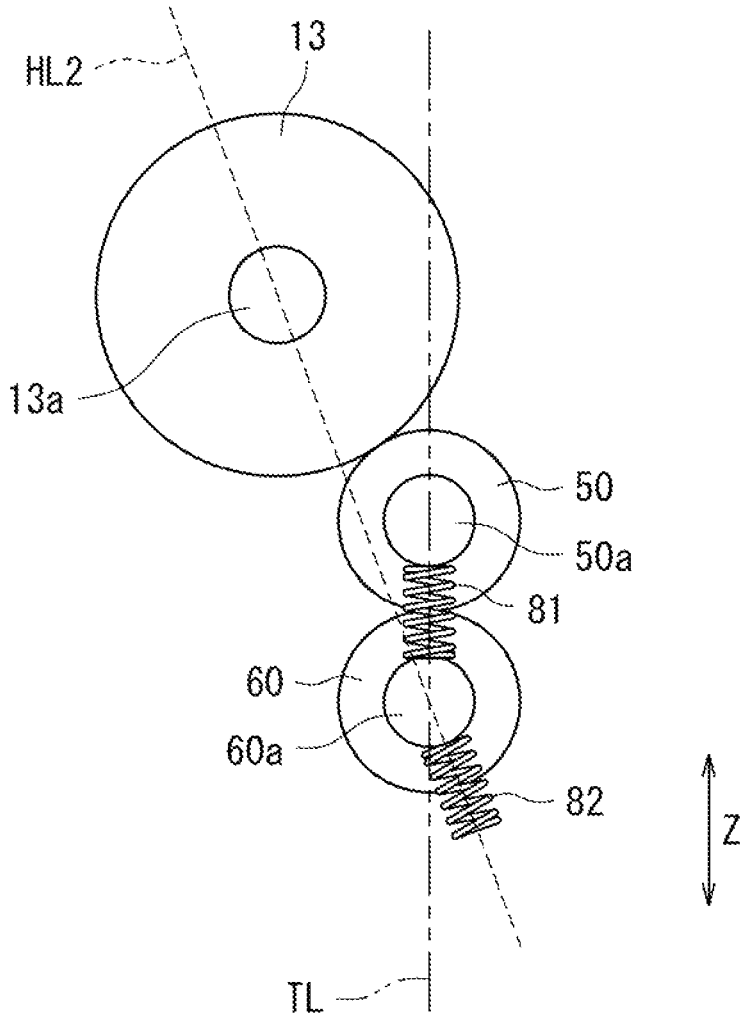
FIG. 10 is a schematic side view indicating a biasing direction in a second arrangement example.

FIG. 10 is a schematic side view indicating the biasing direction in the second arrangement example.

In FIG. 10, the dashed line is a second auxiliary line HL2 passing through the photosensitive drum shaft 13*a* and the cleaning roller shaft 60*a*. In the second arrangement example, the charging roller biasing member 81 is provided along the central axis line TL, and thus the corresponding biasing direction matches the central axis line TL. Also, the cleaning roller biasing member 82 is provided along the second auxiliary line HL2, and thus the corresponding biasing direction matches the second auxiliary line HL2. With this configuration, the cleaning roller biasing member 82 adds the biasing force toward the photosensitive drum 13 while the biasing force from the charging roller biasing member 81 is applied in the direction displaced from the photosensitive drum 13. Thus, it is possible to prevent influence caused by distortion of the shaft of the charging roller 50.

Figure 11:
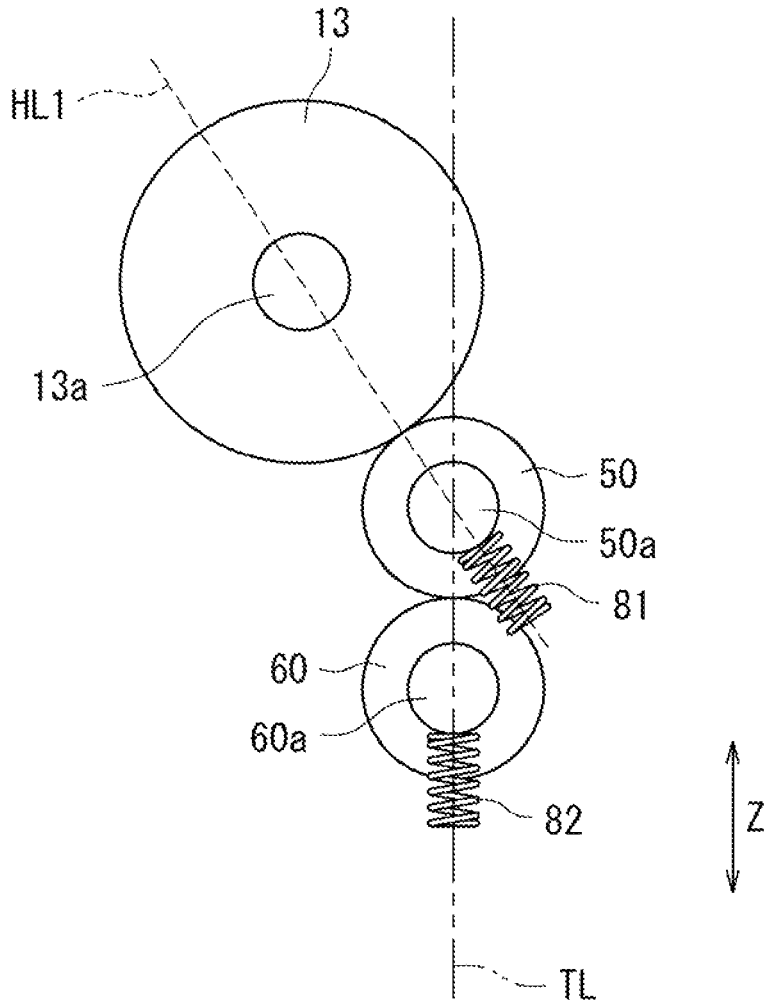
FIG. 11 is a schematic side view indicating a biasing direction in a third arrangement example.

FIG. 11 is a schematic side view indicating the biasing direction in the third arrangement example.

In the third arrangement example, the charging roller biasing member 81 is provided along the first auxiliary line HL1, and thus the corresponding biasing direction matches the first auxiliary line HL1. Also, the cleaning roller biasing member 82 is provided along the central axis line TL, and thus the corresponding biasing direction matches the central axis line TL. With this configuration, it is possible to bias the charging roller 50 toward the photosensitive drum 13 while reducing displacement of the contact position of the charging roller 50 to the photosensitive drum 13, by the biasing force from the cleaning roller biasing member 82 that is added to the charging roller 50 via the cleaning roller 60.

The foregoing embodiment is to be considered in all respects as illustrative and not limiting. The technical scope of the invention is indicated by the appended claims rather than by the foregoing description, and all modifications and changes that come within the meaning and range of equivalency of the claims are intended to be embraced therein.

What is claimed is:

1. A process unit transferring a toner image, comprising:

a photosensitive drum on a surface of which a toner image is formed;

a charging roller being pressed against the photosensitive drum so as to charge the photosensitive drum;

a cleaning roller being pressed against the charging roller so as to clean the charging roller; and at least one biasing member biasing the charging roller and the cleaning roller, wherein a central axis of the photosensitive drum is located at a position not overlapping with a central axis line passing through a central axis of the charging roller and a central axis of the cleaning roller, a biasing direction of the at least one biasing member is on a same line as the central axis line, a distance between the central axis of the charging roller and the central axis of the cleaning roller is fixed by at least one bearing part, and the at least one biasing member biases the charging roller and the cleaning roller via the at least one bearing part.

2. The process unit according to claim 1, wherein the charging roller and the cleaning roller are disposed under the photosensitive drum in a height direction.

3. The process unit according to claim 1, wherein the charging roller has a crown shape.

4. An image forming apparatus comprising the process unit according to claim 1.

* * * * *